United States Patent [19]

Winkelmann et al.

[11] Patent Number: 4,911,338

[45] Date of Patent: Mar. 27, 1990

[54] REFRACTORY PLATE ASSEMBLY INCLUDING REPLACEABLE REFRACTORY EROSION UNIT

[75] Inventors: Manfred Winkelmann, Krefeld; Udo Muschner, Tönisvorst, both of Fed. Rep. of Germany

[73] Assignee: Didier-Werke AG, Wiesbaden, Fed. Rep. of Germany

[21] Appl. No.: 779,090

[22] Filed: Sep. 23, 1985

[30] Foreign Application Priority Data

Sep. 22, 1984 [DE] Fed. Rep. of Germany ..... 3434857

[51] Int. Cl.[4] ..... B22D 41/08

[52] U.S. Cl. ..... 222/600; 222/606; 266/236; 164/337

[58] Field of Search ..... 222/598, 600, 599, 591, 222/561, 606, 607; 266/285, 236, 271; 164/437, 337

[56] References Cited

U.S. PATENT DOCUMENTS

| | | | |
|---|---|---|---|
| 3,970,283 | 7/1976 | Hind | 222/600 X |
| 4,179,046 | 12/1979 | Jeschke et al. | 222/600 |
| 4,541,553 | 9/1985 | McQuillen, Jr. | 222/591 |
| 4,556,157 | 12/1985 | Shapland | 222/600 |
| 4,561,573 | 12/1985 | Shapland | 222/600 |

FOREIGN PATENT DOCUMENTS

| | | | |
|---|---|---|---|
| 2065850 | 7/1981 | United Kingdom | 222/600 |
| 2081431 | 2/1982 | United Kingdom | 222/591 |

*Primary Examiner*—Joseph J. Rolla

*Attorney, Agent, or Firm*—Wenderoth, Lind & Ponack

[57] ABSTRACT

A movable refractory plate assembly for use in a sliding closure unit for controlling the discharge of molten metal from a metallurgical vessel includes a movable refractory plate having therein at least one aperture and having a sliding surface. A replaceable refractory erosion unit, which may be integral or which may include a separate erosion insert and a separate discharge nozzle, is positioned within the aperture of the movable refractor plate. The erosion unit has therethrough a discharge opening and has a sliding surface aligned with a sliding surface of the movable refractory plate. A frame supports the movable refractory plate for movement, and a support coupling removably mounts the erosion unit with respect to the movable refractory plate.

37 Claims, 2 Drawing Sheets

REFRACTORY PLATE ASSEMBLY INCLUDING REPLACEABLE REFRACTORY EROSION UNIT

BACKGROUND OF THE INVENTION

The present invention relates to a movable refractory plate assembly for use in a sliding closure unit for controlling the discharge of molten metal from a metallurgical vessel, and particularly such an assembly wherein a movable refractory plate is mounted in a frame for movement linearly, rotatably, or swivelly, the movable refractory plate having therein an erosion insert and a replaceable discharge connection or nozzle of refractory material.

As disclosed in DE-OS 28 36 409, it is known to construct refractory outlet nozzles of sliding closure units as replaceable discharge nozzles and to mount them in alignment with discharge openings of movable refractory plates of the sliding closure units by means of metal holders or couplings which in turn can be attached to a metal frame which supports and mounts the movable refractory plate, or, when the movable refractory plate has a metal sheath or jacket, for example as shown in DE-GM 80 09 335, to the metal sheath or jacket itself by means of bayonet or threaded attachments. It furthermore is known to provide a refractory erosion insert, particularly of erosion resistant refractory material, in the discharge opening of the movable refractory plate, this being the traditional arrangement to achieve a longer surface life for the movable refractory plate. Further, it is known to adapt a refractory material of replaceable discharge nozzles to the particular molten material being discharged, thereby also to increase the service life of the movable refractory plate assembly.

SUMMARY OF THE INVENTION

With the above discussion in mind, it is the object of the present invention to provide a movable refractory plate assembly for use in a sliding closure unit for controlling the discharge of molten metal from a metallurgical vessel, which particularly is adapted to allow simple and quick replacement of an erosion unit in an aperture of a movable refractory plate, thereby making it possible to adapt the movable refractory plate assembly to the particular casting conditions involved.

This object is achieved in accordance with the present invention by the provision of a movable refractory plate assembly comprising a movable refractory plate having therein at least one aperture and having a sliding surface, a replaceable refractory erosion unit positioned within the aperture of the movable refractory plate, the erosion unit having therethrough a discharge opening, and the erosion unit having a sliding surface aligned with the sliding surface of the movable refractory plate, frame means for supporting the movable refractory plate for movement with respect to a stationary refractory plate of the sliding closure unit, with the sliding surface of the movable refractory plate pressed toward a complementary sliding surface of the stationary refractory plate, to thereby selectively bring the discharge opening of the erosion unit into and out of alignment with the discharge opening of the stationary refractory plate, and support coupling means for removably mounting the erosion unit with respect to the movable refractory plate.

In accordance with a particularly preferred arrangement of the present invention, the erosion unit comprises an erosion insert and a discharge nozzle in abutment with the erosion insert, the erosion insert having a surface defining the sliding surface of the erosion unit, and the erosion insert and the discharge nozzle having respective aligned openings defining the discharge opening of the erosion unit. In this arrangement, the erosion insert and the discharge nozzle may be formed of the same or different refractory materials. In accordance with a further arrangement of the present invention, the erosion unit may comprise a single integral member including a portion extending from the movable refractory plate and defining a discharge nozzle.

In accordance with the present invention, the support coupling means may be removably mounted on the frame means, or alternatively the movable refractory plate may have a metal sheath or jacket and the support coupling means may be removably mounted on the metal sheath or jacket.

In accordance with a further feature of the present invention, there is provided a packing joint between the movable refractory plate and the erosion unit. The packing joint increases in size in a direction toward the sliding surfaces, and the packing joint may be formed of a refractory material, such as a refractory fiber material or mixture, and particularly an elastic refractory fiber material or mixture.

In accordance with a further feature of the present invention, the erosion unit has a support surface spaced from the sliding surface and extending generally parallel thereto, with the support coupling means having a surface complementary to and engaging with the support surface of the erosion unit. The erosion unit may have mounted thereon a metal sheath or jacket, with the support surface being on such metal sheath or jacket. In accordance with a further specific arrangement of the present invention, the packing joint between the movable refractory plate and the erosion unit may be filled with an elastic material, and there may be provided means between the support coupling means and the erosion unit for urging the erosion unit in a direction to be pressed toward the stationary refractory plate, thereby compressing the elastic packing joint. Such urging means may comprise at least one spring positioned between the support coupling means and a stop or abutment surface of the erosion unit.

By the above arrangements, the replaceable erosion unit can be replaced from the outside while the metallurgical vessel is still hot, without requiring opening or disassembly of the sliding closure unit as a whole. In other words, such replacement may be achieved without removal of the movable sliding plate and/or the frame thereof. The progressive erosion of the sliding surface in the area around the discharge opening occurs solely in the erosion unit, for example in the erosion insert. Accordingly, with the relatively easy replacement of the erosion unit in accordance with the present invention, the cost of the refractory erosion material can be lowered remarkably. An additional advantage of this arrangement is that, when it becomes necessary to change the refractory material on short notice due to a change in the particular casting conditions, the erosion unit can be quickly replaced. This is particularly advantageous when it becomes necessary to conduct a special casting program or casting of a particular molten material.

The provision of the support surface on the erosion unit and the complementary surface of the support coupling means facilitates fitting of the erosion unit into the movable refractory plate with the sliding surfaces thereof precisely secured and aligned.

Furthermore, the provision that the packing joint has a dimension increasing in a direction toward the sliding surfaces greatly simplifies the replacement of the elements of the erosion unit as well as the replacement of the material of the packing joint itself.

Furthermore, the provision of the spring between the support coupling means and the erosion unit, in cooperation with the provision of the packing joint being filled with an elastic refractory fiber mixture, provides the additional advantage of an independent elastic pressing of the erosion unit within the also elastically pressed movable refractory plate. This contributes to improvement of the seal between the movable refractory plate and the stationary refractory plate in the area at which erosion will occur during use of the sliding closure unit.

BRIEF DESCRIPTION OF THE DRAWINGS

Other objects, features and advantages of the present invention will become apparent from the following detailed description, taken with the accompanying drawings, wherein.

DETAILED DESCRIPTION OF THE INVENTION

Figure 1:
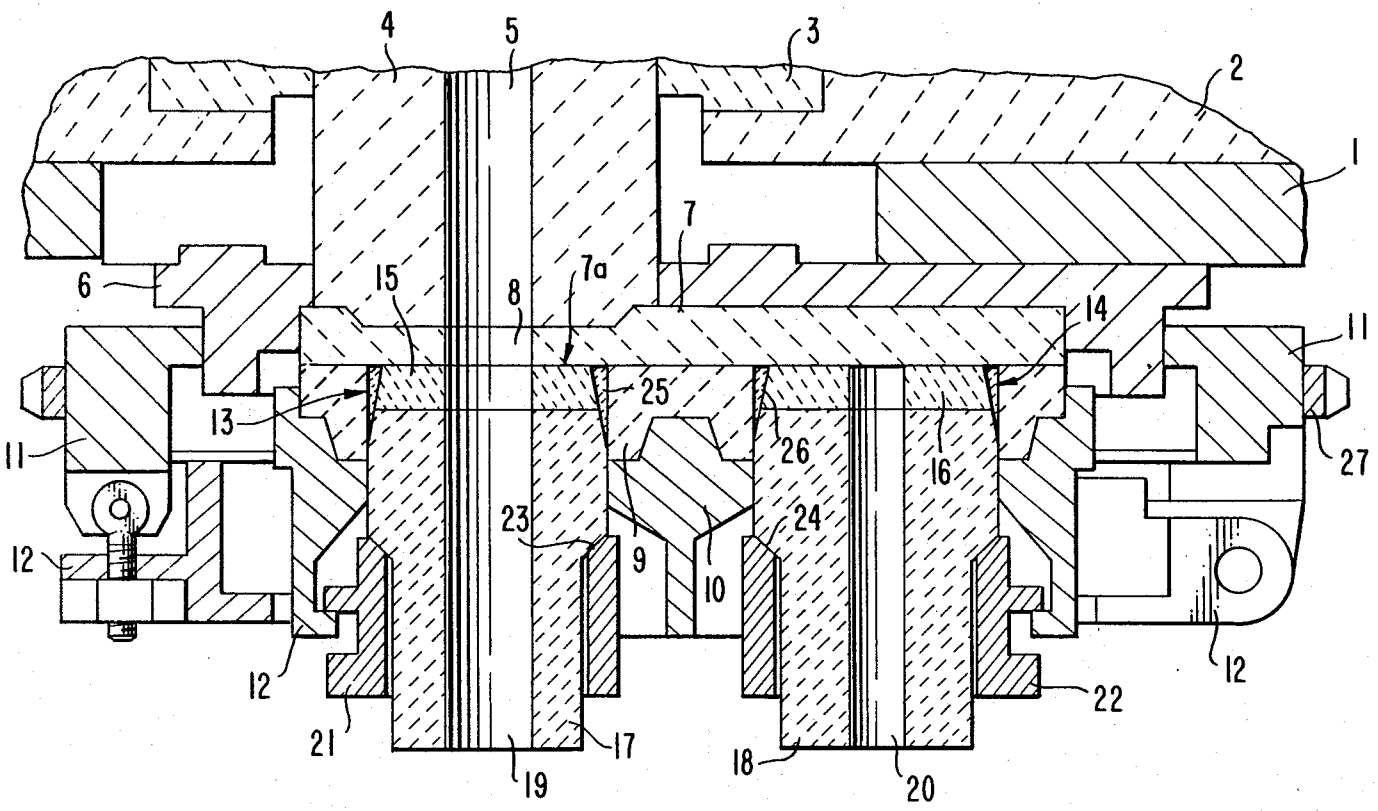
FIG. 1 is a cross sectional view through a rotary sliding closure unit including a movable refractory plate assembly according to the present invention.

In FIG. 1 is shown a portion of a metallurgical vessel including a metal, for example steel, jacket 1, a refractory lining 2, a perforated nozzle brick 3, and an inlet sleeve 4 having therethrough a discharge opening 5 for discharge of molten metal from the metallurgical vessel to a rotary sliding closure unit. The rotary sliding closure unit includes a base or stationary refractory plate 7 mounted on a bottom plate 6 below inlet sleeve 4. Stationary refractory plate 7 has therethrough a discharge opening aligned with discharge opening 5 of sleeve 4. A rotary movable refractory plate 9 is supported in a carrier frame 10 arranged in a rotary frame 11 having an articulated or pivoted cover 12 forming an abutment which operates to adjustably press rotary movable refractory plate 9 toward stationary refractory plate 7, thereby pressing a sliding surface 9*a* of refractory plate 9 against a complementary abutting sliding surface 7*a* of refractory plate 7. Rotation of frame 11, frame 10 and rotary movable refractory plate 9 is achieved in a conventional manner, for example by rotary drive structure acting on teeth 27 on frame 11.

Refractory plate 9 has therethrough apertures 13, 14 into each of which is fitted a replaceable refractory erosion unit. Each erosion unit includes a respective refractory erosion insert 15, 16 and a respective discharge sleeve or nozzle 17, 18 abutting the respective erosion insert and extending downwardly therefrom. Each erosion unit including the respective erosion insert 15 or 16 and the respective discharge nozzle 17 or 18 includes a common discharge opening 19 or 20 adapted to be moved into alignment with discharge openings 5, 8 by the above discussed rotary movement.

The erosion units are mounted or supported by respective support couplings 21, 22. In the embodiment of FIG. 1, the support couplings 21, 22 are supported by articulated cover 12 of frames 10, 11. Further, each discharge nozzle 17, 18 has a respective machined support surface 23, 24 spaced from the respective sliding surface. Each support coupling 21, 22 has a surface complementary to and in abutment with respective support surface 23, 24. In a known manner, the support couplings may be mountable within frame cover 12 by bayonet attachment devices. By this arrangement, it will be apparent that support couplings 21, 22 support the respective erosion units and are adjustably pressed by frame cover 12, thereby positioning and maintaining the erosion units within respective apertures 13, 14. Accordingly, erosion inserts 15, 16 have sliding surfaces which are pressed against sliding surface 7*a* of stationary refractory plate 7, thereby forming a continuous or homogeneous sliding surface with sliding surface 9*a* of plate 9.

Figure 2:
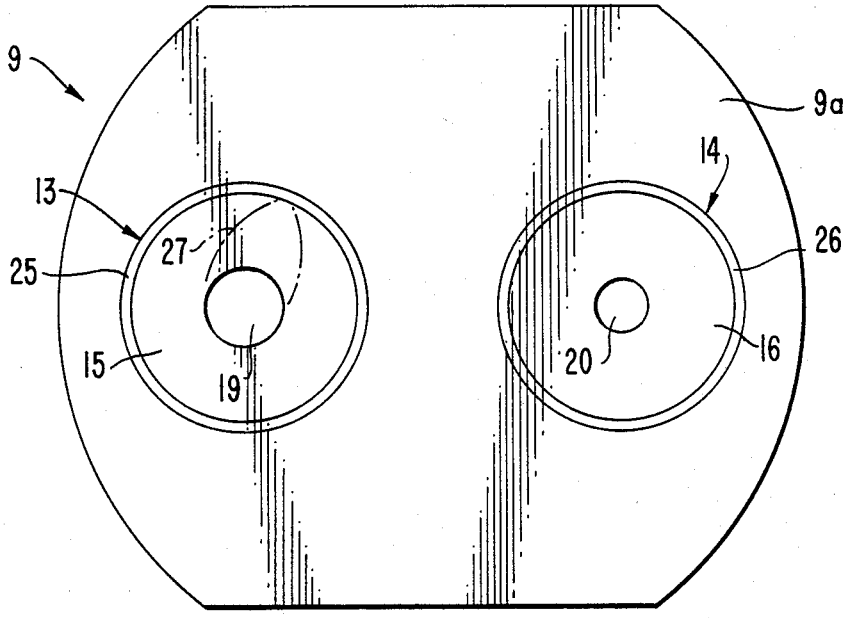
FIG. 2 is a plan view of the rotary refractory plate of FIG. 1.

Additionally, between the top edge of each erosion unit and the surface of refractory plate 9 defining the respective aperture 13, 14 there is formed an annular packing joint 25, 26 filled with a packing material. This packing material is applied before the mounting of the erosion units and completely fills joints 25, 26 after assembly, thereby ensuring that the assembly of the movable refractory plate and the erosion units is ready for use. Excess packing material optionally can be discharged downwardly from joints 25, 26 through free spaces provided between refractory plate 9 and the respective erosion units. Following subsequent assembly, the rotary sliding closure unit can be operated to move plate 9 back and forth several times for adjustment, to ensure a proper seal between the respective sliding surfaces. When the unit is entirely assembled, then operation of the rotary sliding closure unit will be carried out in the normal manner to close, restrict or open the discharge of molten metal from the metallurgical vessel, through respective of the discharge openings 19 or 20. In this regard, the embodiment of FIGS. 1 and 2 illustrates discharge openings 19, 20 of being of different size, but of course the discharge openings could be of the same size. Furthermore, there could be provided more than two such discharge openings and associated erosion units.

As shown in FIG. 2, the diameter of the erosion inserts 15, 16 is sufficient to encompass the customary or anticipated area of erosion 27 which occurs during use of the rotary sliding unit, and also the abrasions which occur at the refractory plate edges during constriction of the flow of molten metal. As a result, replacement of the erosion units enables the refractory plate 9 to be used again. Furthermore, during replacement of the erosion units, stationary refractory plate 7 also can be repaired, since a sufficiently large work area is freed beneath discharge opening 8 of plate 7 upon removal of the erosion units. Thus, there is provided sufficient space to achieve application of repair refractory material and planing thereof, including grinding to repair sliding surface 7*a*.

Figure 3:
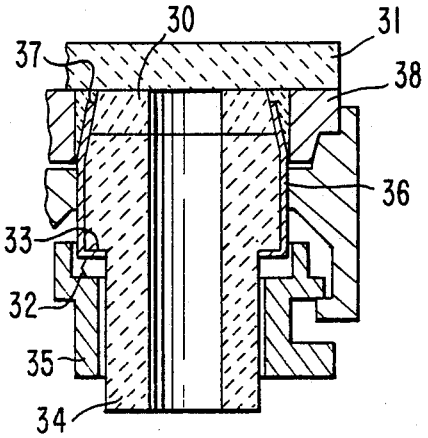
FIG. 3 is a partial cross sectional view of another embodiment of a movable refractory plate assembly according to the present invention.

The packing material of joints 25, 26 can, for example, be refractory mortar, etc., or a refractory fiber material. Specifically, in the embodiment of FIG. 3 there is shown an arrangement whereby the packing joint 37 is filled with an elastic refractory fiber material. FIG. 3 shows a further embodiment of the present invention, wherein the erosion unit including erosion insert 30 and discharge sleeve 34 have a surrounding metal sheath 36. The discharge nozzle 34 further has a stop surface 33 defined by a flat annular metal ring, and between stop surface 33 and support coupling 35 is positioned at least one spring 32 to urge the erosion unit upwardly toward stationary refractory plate 31. This compresses the elastic packing material of packing joint 37. The movable refractory plate is shown at 38.

Figure 4:
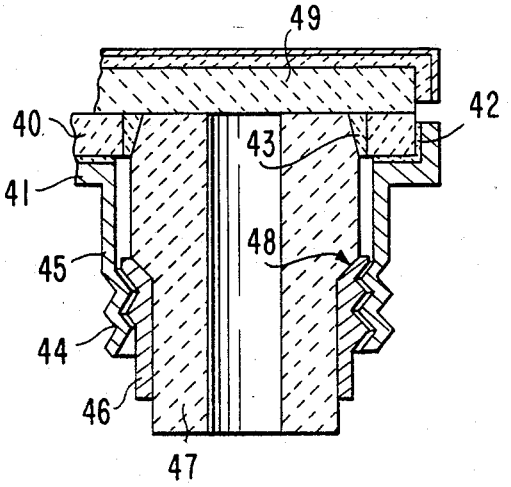
FIG. 4 is a partial cross sectional view similar to FIG. 3, but of a still further embodiment of the present invention.

FIG. 4 shows a further embodiment of the present invention wherein support coupling 46 is attached to a metal sheath or jacket of the movable refractory plate 40. Thus, movable refractory plate 40 has attached thereto by means of a mortar layer 42 a metal jacket or sheath 41 which has depending downwardly therefrom a flange 45 having a threaded portion 44. Support coupling 46 has complementary threads such that the coupling may be threaded into portion 44, with support coupling 46 having a surface complementary to and abutting a support surface 48 of erosion unit 47. FIG. 4 also shows stationary refractory plate 49 enclosed by a metal sheath or jacket. FIG. 4 also illustrates a further arrangement of the present invention wherein the erosion unit comprises a single integral member 47, rather than the two separate refractory members, i.e. the erosion insert and the discharge nozzle, in the previous embodiments. It will be apparent however that the embodiment of FIG. 4 may include an arrangement whereby the erosion unit includes a separate erosion insert and discharge nozzle.

Figure 5:
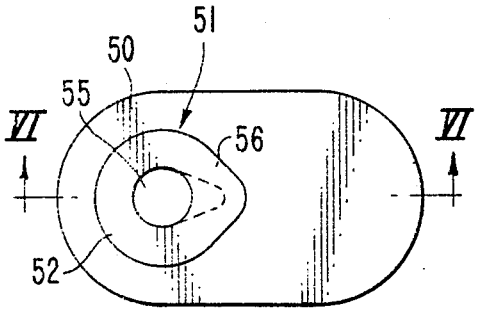
FIG. 5 is a plan view of a linearly movable refractory plate according to a still further embodiment of the present invention.
Figure 6:
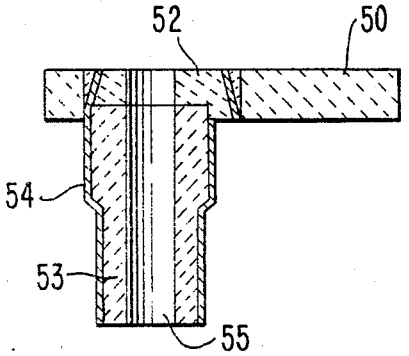
FIG. 6 is a cross section taken along line VI—VI of FIG. 5.

FIGS. 5 and 6 illustrate an arrangement of the present invention for a linearly movable sliding closure unit including a linearly movable refractory plate 50 having therein an aperture 51 into which is fitted an erosion unit including an erosion insert 52 and a discharge nozzle 53, both of which are enclosed by a metal sheath or jacket 54. In this embodiment, the erosion insert 52 is elongated in the anticipated direction of erosion during use of the sliding closure unit, thereby to encompass erosion area 56. Thus, as particularly shown in FIG. 6, the erosion insert 52 extends in this elongated area beyond the discharge nozzle 53. The erosion unit components 52, 53 have therethrough a common discharge opening 55. The assembly shown in FIGS. 5 and 6 may be mounted by a support coupling in the various manners discussed above regarding the previous embodiments.

Whether the erosion inserts and the discharge nozzles are formed of the same or different refractory materials is determined by the particular casting program or operation involve. For example, a particular arrangement may include a rotary sliding closure unit as shown in FIG. 1, wherein rotary refractory plate 9 may be formed of $Al_2O_3$, erosion inserts 15, 16 can be formed of erosion resistant $ZrO_2$, and discharge nozzles 17, 18 can be formed of $Al_2O_3$. If the casting operation or program of the particular ladle is changed, then the erosion inserts and discharge nozzles can be replaced quickly, with components of different materials as necessary. For example, it would be possible to replace the above erosion inserts with erosion inserts formed of MgO, and this operation can be done quite rapidly. The refractory plate 9 in the area outwardly of erosion insert 15, and beneath discharge openings 5, 8, can be charged at approximately 400°, and replaceable discharge nozzles 17, 18 can be adapted to the particular casting operation. Separate erosion inserts and discharge nozzles advantageously may be mounted in metal sheaths or jackets by means of refractory mortar, cement or glue, thereby to form erosion units which quickly and easily can be handled and replaced.

Although the present invention has been described and illustrated with respect to preferred embodiments thereof, it will be understood that various modifications and changes may be made to the specifically described and illustrated arrangements without departing from the scope of the present invention.

We claim:

1. A movable refractory plate assembly for use in a sliding closure unit for controlling the discharge of molten metal from a metallurgical vessel, said assembly comprising:

a movable refractory plate having therein at least one aperture and having a sliding surface;

a replaceable refractory erosion unit positioned within said aperture of said movable refractory plate, said erosion unit having therethrough a discharge opening, and said erosion unit having a sliding surface aligned with said sliding surface of said movable refractory plate, said sliding surface of said erosion unit having a dimension outwardly of said discharge opening sufficient to encompass an area of erosion occurring at said sliding surface and around said discharge opening during use of said assembly, said erosion unit comprising an erosion insert and a discharge nozzle in abutment with said erosion insert, said erosion insert being substantially shaped as a disc and having a surface defining said sliding surface of said erosion unit, and said erosion insert and said discharge nozzle having respective aligned openings defining said discharge opening of said erosion unit;

frame means for supporting said movable refractory plate for movement with respect to a stationary refractory plate of a sliding closure unit, with said sliding surface of said movable refractory plate pressed toward a complementary sliding surface of the stationary refractory plate, to thereby selectively bring said discharge opening of said erosion unit into and out of alignment with a discharge opening in the stationary refractory plate; and support coupling means for removably mounting said erosion unit with respect to said movable refractory plate, such that said erosion unit is removable from said movable refractory plate in a direction away from said sliding surface without moving said movable refractory plate away from the stationary refractory plate of the sliding closure unit.

2. An assembly as claimed in claim 1, wherein said erosion insert and said discharge nozzle are formed of the same refractory materials.

3. An assembly as claimed in claim 1, wherein said erosion insert and said discharge nozzle are formed of different refractory materials.

4. An assembly as claimed in claim 1, wherein said support coupling means is removably mountable on said frame means.

5. An assembly as claimed in claim 1, wherein said movable refractory plate has mounted thereon a metal jacket, and said support coupling means is removably mountable on said metal jacket.

6. An assembly as claimed in claim 1, further comprising a packing joint between said movable refractory plate and said erosion unit.

7. An assembly as claimed in claim 6, wherein said packing joint increases in size in a direction toward said sliding surfaces.

8. An assembly as claimed in claim 1, wherein said erosion unit has a support surface spaced from said sliding surface and extending parallel thereto, and said support coupling means has a surface complementary to and engaging with said support surface of said erosion unit.

9. An assembly as claimed in claim 8, wherein said erosion unit has mounted thereon a metal sheath, and said support surface is on said metal sheath.

10. An assembly as claimed in claim 1, further comprising an elastic packing joint between said movable refractory plate and said erosion unit, and means between said support coupling means and said erosion unit for urging said erosion unit in a direction to be pressed toward the stationary refractory plate and for compressing said elastic packing joint.

11. An assembly as claimed in claim 10, wherein said elastic packing joint is formed by an elastic refractory fiber material.

12. An assembly as claimed in claim 10, wherein said urging means comprises at least one spring positioned between said support coupling means and an abutment surface of said erosion unit.

13. A movable refractory plate assembly for use in a sliding closure unit for controlling the discharge of molten metal from a metallurgical vessel, said assembly comprising:

a movable refractory plate having therein at least one aperture and having a sliding surface;

a replaceable refractory erosion unit positioned within said aperture of said movable refractory plate, said erosion unit having therethrough a discharge opening, and said erosion unit having a sliding surface aligned with said sliding surface of said movable refractory plate, said sliding surface of said erosion unit having a dimension outwardly of said discharge opening sufficient to encompass an area of erosion occurring at said sliding surface and around said discharge opening during use of said assembly;

a packing joint between said movable refractory plate and said erosion unit;

frame means for supporting said movable refractory plate for movement with respect to a stationary refractory plate of a sliding closure unit, with said sliding surface of said movable refractory plate pressed toward a complementary sliding surface of the stationary refractory plate, to thereby selectively bring said discharge opening of said erosion unit into and out of alignment with a discharge opening in the stationary refractory plate; and support coupling means for removably mounting said erosion unit with respect to said movable refractory plate, such that said erosion unit is removable from said movable refractory plate in a direction away from said sliding surface without moving said movable refractory plate away from the stationary refractory plate of the sliding closure unit.

14. An assembly as claimed in claim 13, wherein said erosion unit comprises a single integral member including a portion extending from said movable refractory plate and defining a discharge nozzle.

15. An assembly as claimed in claim 13, wherein said support coupling means is removably mountable on said frame means.

16. An assembly as claimed in claim 13, wherein said packing joint increases in size in a direction toward said sliding surfaces.

17. An assembly as claimed in claim 13, wherein said erosion unit comprises an erosion insert and a discharge nozzle in abutment with said erosion insert, said erosion insert having a surface defining said sliding surface of said erosion unit, and said erosion insert and said discharge nozzle having respective aligned openings defining said discharge opening of said erosion unit.

18. An assembly as claimed in claim 17, wherein said erosion insert and said discharge nozzle are formed of the same refractory materials.

19. An assembly as claimed in claim 17, wherein said erosion insert and said discharge nozzle are formed of different refractory materials.

20. An assembly as claimed in claim 13, wherein said movable refractory plate has mounted thereon a metal jacket, and said support coupling means is removably mountable on said metal jacket.

21. An assembly as claimed in claim 20, wherein said urging means comprises at least one spring positioned between said support coupling means and an abutment surface of said erosion unit.

22. An assembly as claimed in claim 13, wherein said erosion unit has a support surface spaced from said sliding surface and extending parallel thereto, and said support coupling means has a surface complementary to and engaging with said support surface of said erosion unit.

23. An assembly as claimed in claim 22, wherein said erosion unit has mounted thereon a metal sheath, and said support surface is on said metal sheath.

24. An assembly as claimed in claim 13, wherein said packing joint comprises an elastic packing joint, and further comprising means between said support coupling means and said erosion unit for urging said erosion unit in a direction to be pressed toward the stationary refractory plate and for compressing said elastic packing joint.

25. As assembly as claimed in claim 24, wherein said elastic packing joint is formed by an elastic refractory fiber material.

26. An assembly as claimed in claim 24, wherein said urging means comprises at least one spring positioned between said support coupling means and an abutment surface of said erosion unit.

27. A movable refractory plate assembly for use in a sliding closure unit for controlling the discharge of molten metal from a metallurgical vessel, said assembly comprising:

a movable refractory plate having therein at least one aperture and having a sliding surface;

a replaceable refractory erosion unit positioned within said aperture of said movable refractory plate, said erosion unit having therethrough a discharge opening, and said erosion unit having a sliding surface aligned with said sliding surface of said movable refractory plate, said sliding surface of said erosion unit having a dimension outwardly of said discharge opening sufficient to encompass an area of erosion occurring at said sliding surface and around said discharge opening during use of said assembly;

an elastic packing joint between said movable refractory plate and said erosion unit;

frame means for supporting said movable refractory plate for movement with respect to a stationary refractory plate of a sliding closure unit, with said sliding surface of said movable refractory plate pressed toward a complementary sliding surface of the stationary refractory plate, to thereby selectively bring said discharge opening of said erosion unit into and out of alignment with a discharge opening in the stationary refractory plate;

support coupling means for removably mounting said erosion unit with respect to said movable refractory plate, such that said erosion unit is removable from said movable refractory plate in a direction away from said sliding surface without moving said movable refractory plate away from the stationary refractory plate of the sliding closure unit; and means between said support coupling means and said erosion unit for urging said erosion unit in a direction to be pressed toward the stationary refractory plate and for compressing said elastic packing joint.

28. An assembly as claimed in claim 27, wherein said erosion unit comprises a single integral member including a portion extending from said movable refractory plate and defining a discharge nozzle.

29. An assembly as claimed in claim 27, wherein said support coupling means is removably mountable on said frame means.

30. An assembly as claimed in claim 27, wherein said movable refractory plate has mounted thereon a metal jacket, and said support coupling means is removably mountable on said metal jacket.

31. An assembly as claimed in claim 27, wherein said packing joint increases in size in a direction toward said sliding surfaces.

32. An assembly as claimed in claim 27, wherein said elastic packing joint is formed by an elastic refractory fiber material.

33. An assembly as claimed in claim 27, wherein said erosion unit comprises an erosion insert and a discharge nozzle in abutment with said erosion insert, said erosion insert having a surface defining said sliding surface of said erosion unit, and said erosion insert and said discharge nozzle having respective aligned openings defining said discharge opening of said erosion unit.

34. An assembly as claimed in claim 33, wherein said erosion insert and said discharge nozzle are formed of the same refractory materials.

35. An assembly as claimed in claim 33, wherein said erosion insert and said discharge nozzle are formed of different refractory materials.

36. An assembly as claimed in claim 27, wherein said erosion unit has a support surface spaced from said sliding surface and extending parallel thereto, and said support coupling means has a surface complementary to and engaging with said support surface of said erosion unit.

37. An assembly as claimed in claim 36, wherein said erosion unit has mounted thereon a metal sheath, and said support surface is on said metal sheath.

* * * * *